US010925381B2

(12) United States Patent
Lystrup et al.

(10) Patent No.: US 10,925,381 B2
(45) Date of Patent: Feb. 23, 2021

(54) HAMMOCK SHELL SYSTEM

(71) Applicant: Khione Outdoor Gear, LLC, Orem, UT (US)

(72) Inventors: John Caleb Lystrup, Provo, UT (US); Casey Owen Messick, Orem, UT (US); Mary Alice Hunter, Alpine, UT (US)

( * ) Notice: Subject to any disclaimer, the term of this patent is extended or adjusted under 35 U.S.C. 154(b) by 117 days.

(21) Appl. No.: 15/957,616

(22) Filed: Apr. 19, 2018

(65) Prior Publication Data

US 2018/0303229 A1 Oct. 25, 2018

Related U.S. Application Data

(60) Provisional application No. 62/487,062, filed on Apr. 19, 2017.

(51) Int. Cl.
*A45F 3/22* (2006.01)
*A45F 3/24* (2006.01)

(52) U.S. Cl.
CPC . *A45F 3/22* (2013.01); *A45F 3/24* (2013.01)

(58) Field of Classification Search
CPC ..... A45F 3/22; A45F 3/24; A45F 3/52; A47C 17/84; E04H 15/04; A47G 9/08; A47G 9/083; A47G 9/086
USPC ..... 5/122, 120, 121, 128, 413 R, 413 AM; 2/69, 69.5
See application file for complete search history.

(56) References Cited

U.S. PATENT DOCUMENTS 326,321 A * 9/1885 Nickerson ..... A45F 3/22 5/121
329,763 A * 11/1885 Nelmes et al. ..... A45F 3/22 5/121
348,685 A * 9/1886 Nelmes ..... A45F 3/22 5/121
688,029 A * 12/1901 Palmer ..... A45F 3/22 5/121
818,882 A * 4/1906 Graeme ..... A45F 3/22 5/121
1,343,800 A * 6/1920 Trimm ..... E04H 15/04 5/121

(Continued)

FOREIGN PATENT DOCUMENTS

WO WO-2020082093 A1 * 4/2020 ..... A45F 3/22

*Primary Examiner* — Robert G Santos
(74) *Attorney, Agent, or Firm* — Strong & Hanni, P.C.; Joseph Shapiro

(57) ABSTRACT

A hammock shell system may comprise a hammock, a tension line, and a shell. The tension line may be secured to run above the hammock, and along the length of the hammock. The shell may be a tubular piece of fabric with openings at either end, and shaped to generally hang over the tension line, and fit around and envelop the hammock. The shell may drape over the edges of the two sides of the hammock and hang under the bottom of the hammock. When the two openings at the ends of the shell are closed, a layer of dead air is created between the shell and the bottom of the hammock. This dead air space insulates the bottom of the hammock. A shape adjustment system, comprising cinch cords on the inside of the shell, allows for tightening or loosening to adjust the shape and volume of the dead air space trapped between the bottom of the hammock and the shell. Such shape adjustment allows for customizing insulation properties and the temperature of the hammock. The shell may also include insulating materials.

20 Claims, 7 Drawing Sheets

(56) References Cited

U.S. PATENT DOCUMENTS 3,787,906 A * 1/1974 Hunt ..... A47G 9/086 5/413 R
3,798,686 A * 3/1974 Gaiser ..... A47C 27/084 5/413 AM
3,857,125 A * 12/1974 Hunt ..... A47G 9/086 5/413 R
3,878,574 A * 4/1975 Erickson ..... A47G 9/086 5/413 R
3,959,834 A * 6/1976 Hunt ..... A47G 9/086 5/413 R
4,092,750 A * 6/1978 Ellis ..... A47C 27/081 5/413 AM
4,884,303 A * 12/1989 Scherer ..... A47G 9/086 5/413 R
5,072,465 A * 12/1991 Lyons, Jr. ..... A47C 17/84 135/90
5,257,427 A * 11/1993 Hinshaw ..... A47G 9/086 2/69
8,499,381 B1 * 8/2013 Miller ..... A47G 9/086 2/69.5
8,936,034 B2 * 1/2015 Rhett, Jr. ..... E04H 15/34 135/90
9,314,090 B1 * 4/2016 Manning ..... E04H 15/04
9,788,639 B2 * 10/2017 Frazer ..... A45F 3/22
2014/0158174 A1 * 6/2014 Rhett, Jr. ..... E04H 15/34 135/121
2016/0213130 A1 * 7/2016 Frazer ..... A45F 3/22
2018/0303229 A1 * 10/2018 Lystrup ..... A45F 3/22
2020/0121064 A1 * 4/2020 TenBrink ..... E04H 15/02
2020/0123801 A1 * 4/2020 Tillotson ..... A45F 3/52

* cited by examiner

HAMMOCK SHELL SYSTEM

BACKGROUND OF THE INVENTION

Hammock camping is growing in popularity for multiple reasons. Hammocks are comfortable. Hammocks are lightweight and compact. Hammocks do not require a flat or clear piece of ground. Hammocks can be supported between two trees or other sturdy objects. Hammocks are easy to set up. Although hammocks have many advantages, they are not without drawbacks. One drawback of current hammocks is lack of warmth and protection from the elements. Because the underside of a hammock is exposed to outside air, it can become very cold when the outside air is cold. This can result in cold conditions for a user sleeping in or otherwise using a hammock. For example, a person sleeping in a hammock on his/her back may experience significant chill on his/her back.

Previous efforts to address the cold from the underside of the hammock suffer from significant drawbacks. One approach has been to add insulating material on the outside or inside (or both) of the hammock. For example, underquilts made of insulating material may be secured to be in contact with the underside of the hammock. An underquilt may provide some insulation, but because the effectiveness of an underquilt depends significantly on the amount of insulating material in the underquilt, a good underquilt may be large, bulky, heavy, and/or costly.

In another approach, a pad may be placed on the hammock and under the user. Although a pad may provide some benefits, the insulation in a pad has limitations because it is compressed by the weight of a user (i.e., a sleeper) of a hammock. Also, because a pad may be made of stiffer material to preserve the density characteristics of the pad, a pad may be heavy, difficult to pack (e.g., compact, fold, roll, or otherwise compress). Additionally, a pad may shift during use and may be expensive.

One approach that has been used for warmth/insulation on the top of a hammock user is a top-quilt, which is essentially a blanket or a top half of a sleeping bag. Although a top-quilt may be somewhat effective, a top-quilt is large, bulky, heavy, expensive, and is another item to be packed and/or transported.

In general, adding insulation material to a hammock suffers from significant drawbacks. The insulation is often compressed by a user's bodyweight or in other ways, thereby significantly decreasing the effectiveness of the insulation. Adding sufficient insulation to counteract the compression, or adding structural components to prevent compression, results in a heavy, clunky, and unwieldy hammock. This is undesirable for camping and backpacking.

Additionally, hammockers generally employ some type of solution for rain protection, which may be a tarp hung over a ridgeline (a rope spanning the trees, above the hammock) and secured with tie-downs and stakes. Multiple variants of the insulating and rain-protection systems are available, but all generally suffer from the drawbacks disclosed herein.

What is needed is a system and method for insulating the underside of a hammock, or other parts of a hammock, in a manner that is lightweight, convenient, adjustable, minimal, and easy to use.

BRIEF SUMMARY OF THE INVENTION

A system and method are disclosed for insulating a hammock. In one embodiment, a tension line is installed above a hammock to run along the length of the hammock. The tension line may be adjustable.

A tubular shell, with openings at either end so it slides over the tension line and around the hammock, thereby enveloping the hammock. The shell hangs from the tension line and drapes over the two sides of the hammock. The shell may include cinch cords for closing the two ends of the shell, thereby creating an insulating dead air layer between the shell and the bottom of the hammock.

A system of adjusting cords may be used to cinch and un-cinch the shell to adjust the shape and volume of the insulating dead air layer between the shell and the bottom of the hammock. Using this adjusting system, the insulating properties of the dead air layer may be adjusted.

The shell may be filled with insulating material to improve its insulating performance.

The shell may be reflective to improve insulating properties.

The shell may be waterproof.

DETAILED DESCRIPTION OF THE INVENTION

Figure 1:
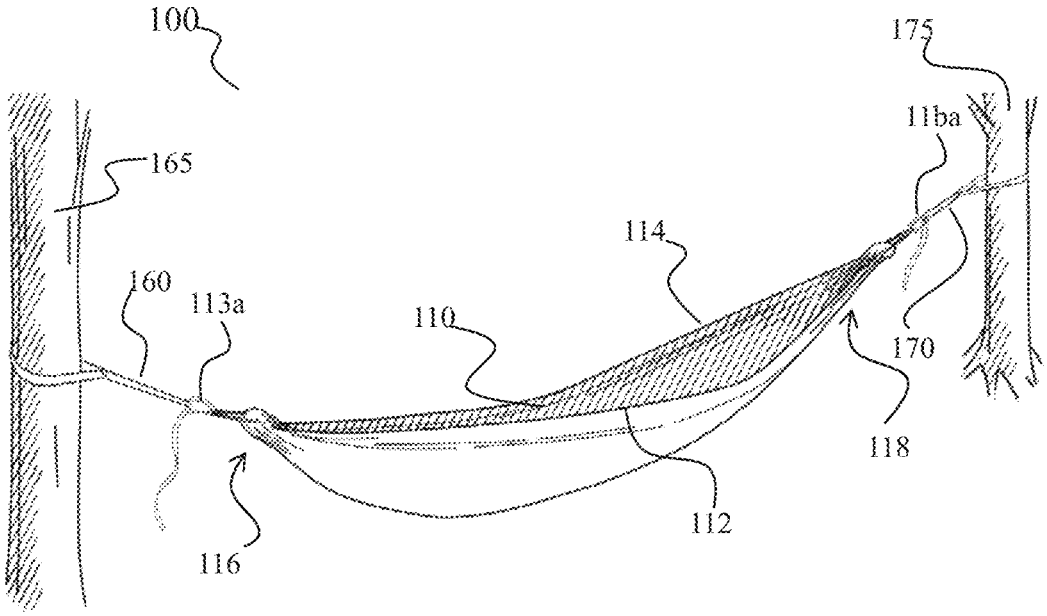
FIG. 1 shows an elevated angle view of a hammock.

This Application claims priority to U.S. Provisional No. 62/487,062, filed on Apr. 19, 2017, and titled "Hammock Shell System" (first named inventor: John Caleb Lystrup).

A system and method for a Hammock Shell System is disclosed herein. In one embodiment, a Hammock Shell System may comprise a hammock enclosed in an insulating shell that is supported by a tension line.

TABLE OF REFERENCE NUMBERS FROM DRAWINGS

The following table is for convenience only, and should not be construed to supersede any potentially inconsistent disclosure herein.

| Reference Number | Description |
|---|---|
| 100 | Hammock Shell System |
| 110 | hammock |
| 112 | first hammock edge |
| 113a-b | hammock support loops |
| 114 | second hammock edge |
| 116 | first hammock end |
| 118 | second hammock end |
| 150 | tension line |
| 151 | first tension line securement adapter |
| 152 | second tension line securement adapter |
| 160 | first hammock installation strap |
| 165 | first support tree |
| 170 | second hammock installation strap |
| 175 | second support tree |
| 200 | shell |
| 201 | lower layer of shell for enclosing insulation |
| 202 | upper layer of shell for enclosing insulation |
| 205 | first end of shell |
| 206 | first cinch cord |
| 210 | second end of shell |
| 211 | second cinch cord |
| 230 | air insulation layer |
| 250a-n | elastic cinch adjustment cords |
| 255 | bunching of cinched fabric |
| 260 | insulating material |
| 270 | shell door |
| 281 | first window |
| 282 | second window |
| 500 | method for using hammock shell system |

Overview of Hammock Shell System

As shown in FIGS. 1-13, Hammock Shell System 100 may comprise hammock 110, tension line 150, and shell 200. Shell 200 may hang from or be draped over tension line 150 and may further be draped over edges 112 and 114 of hammock 110. Because shell 200 is draped over tension line 150 and hammock edges 112 and 114, the lower portion of shell 200, i.e., the portion below edges 112 and 114 of hammock 110, hangs under hammock 110, resulting in airspace between hammock 110 and shell 200. Shell 200 may include, in whole or in part, insulating material such as down feathers or synthetic insulation. Shell 200 may further be made of, in whole or in part, waterproof material, or may have a waterproof layer, coating, or application on the inside or outside of shell 200 for some or all of shell 200. Shell 200 may additionally be adjustable to adjust the spacing between hammock 110 and the lower portion of shell 200 that hangs under the hammock 110 to optimize and/or adjust insulation and heat retention properties.

Hammock

In one embodiment, hammock 110 may be one of many hammocks known in the art. For example, hammock 110 may be made of waterproof nylon, or heavy-duty fabric, mesh, rope, or other materials known in the art. In general, hammock 110 could be made from many different textiles or fabrics that are flexible and sturdy enough to support a person. Significant features of the material for hammock 110 may include weight, durability, strength, waterproof characteristics, windproof characteristics, and insulating properties. Nylon has several benefits: it is lightweight, strong, durable, and may be manufactured or treated for waterproof characteristics and/or windproof characteristics. In one embodiment, hammock 110 may be made of nylon. The nylon may have different thread counts or thread thicknesses to match the preference of the user. In particular, ripstop nylon has gained ground in this area as a lightweight yet durable and strong material for outdoor use. In one embodiment, hammock 110 may be made in whole or in part of 20D/30D ripstop nylon with weight of 1.1-1.9 oz/yd$^2$.

The dimensions disclosed herein are merely exemplary. A person of ordinary skill in the art will appreciate that the dimensions of the Hammock Shell System disclosed herein, or of any components of the Hammock Shell System disclosed herein, may be easily modified, adapted, or scaled and remain within the scope of the disclosure herein.

In one embodiment, hammock 110 may be substantially shaped as a rectangle with dimensions of approximately 10'6" (ten feet, six inches)×6'3" (six feet, three inches). Alternatively, hammock 110 may be shaped such that one end, which may be the end intended for the feet of a user, is tapered relative to the other end. A tapered shape, e.g., an elongated trapezoid, may improve efficiency by using less material at the end of hammock 110 at which a user's feet/legs will be placed, and may also improve comfort by conforming hammock 110 to the shaping and contours of a user's body. A person of ordinary skill in the art will appreciate that many shapes are within the scope of the disclosure herein.

Although hammock 110 is described herein as a monolithic piece of material, hammock 110 may be made from multiple pieces of material that are secured to each other, e.g., by sewing.

Hammock 110, as described herein, is merely exemplary, may types and styles of hammocks are known in the art, and are within the scope of the disclosure herein, e.g., a hammock that is hung from four corners, etc.

In one embodiment, edges 112 and 114 and ends 116 and 118 of hammock 110 may be supported by or reinforced by reinforced stitching or other materials or techniques, e.g, by securing nylon strapping (also commonly known as "nylon webbing"), extra material, and/or otherwise reinforced or strengthened seams. Other materials may also be used, e.g., polyester strapping, polypropylene, rope, or other materials. In one embodiment, edges 112 and 114 and ends 116 and 118 may have reinforced stitching, e.g., double or triple stitching As shown in FIGS. 1-4, hammock support loops 113*a* and 113*b* may be metal loops that are mechanically secured to the respective ends 116 and 118 of hammock 110. In one embodiment, hammock support loops 113*a* and 113*b* may be metal loops that are approximately 1.5" (one and a half inches) in diameter, and may be secured to hammock ends 116 and 118 using rope, nylon webbing that is sewn onto hammock ends 116 and 118, or may be secured in one of many other methods or using other parts or adapters known in the art. Hammock support loops 113*a* and 113*b* may be, e.g., carabiners.

Hammock 110 may be set up by securing supports loops 113*a* and 113*b* to hammock installation straps 160 and 170. In one embodiment, hammock installation straps 160 and 170 may be 1" (one inch) nylon webbing configured to loop around a tree. For example, as shown in FIGS. 1-4, hammock installation strap 160 may be a 10' (ten foot) segment of nylon webbing with an integrated hammock adapter at one end. Hammock installation adapter may include an adjustment system. For example, the adjustment system may comprise a system of loops sewn into or otherwise secured to hammock installation strap 162. In one embodiment, the adjustment loops may be formed by sewing segments of nylon webbing onto hammock installation adapter 160. The adjustment system is configured such that the nylon webbing comprising hammock installation strap 160 may be looped around a tree or other support structure, and then threaded through one of the adjustment loops. The adjustment loop through which hammock installation adapter 160 is threaded depends at least on (1) the girth of the tree or other support around which hammock installation strap 160 is looped and/or (2) the distance between trees 165 and 175 between which hammock 110 is hung/installed.

As is well known in the art, hammocks may be hung/installed in many ways. Hammock installation straps 160 and 170 as disclosed herein are merely exemplary, and other methods, systems, components, and apparatuses for hanging a hammock are within the scope of the disclosure herein. In addition to the disclosure herein, hammocks may be hung using many different hanging systems, and from many different support structures. For example, hammock 110 may be hung between trees, posts, walls, or any other items with sufficient structural stability. Hammock installation adapters may comprise nylon webbing, rope, chain, hardware adapters, metal loops, and/or any other components sufficient to secure hammock 110 to support trees 165 and 175 or to any other support structures or items.

Tension Line

Figure 2:
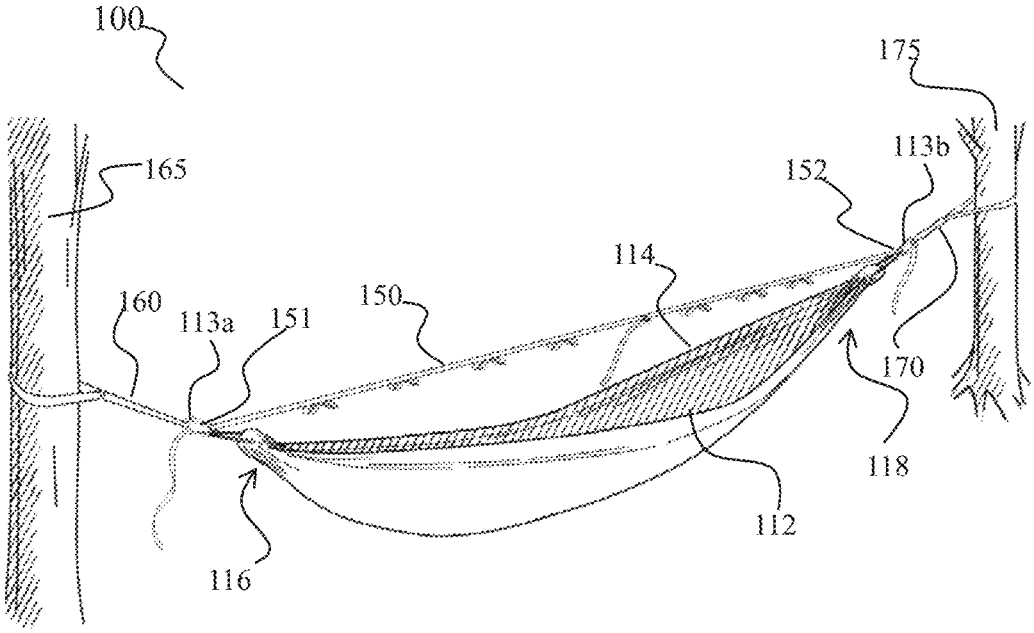
FIG. 2 shows an elevated angle view of a hammock with a tension line installed.
Figure 3:
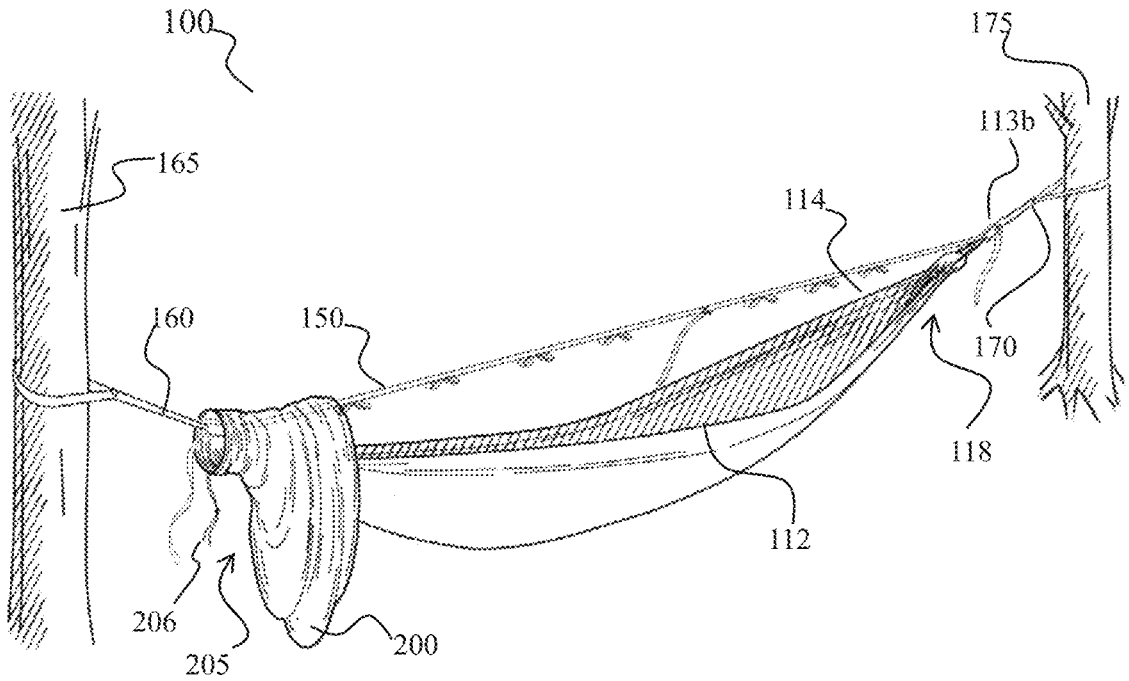
FIG. 3 shows an elevated angle view of a hammock with a tension line installed and a shell bunched at one end but not installed over the entire hammock.
Figure 4:
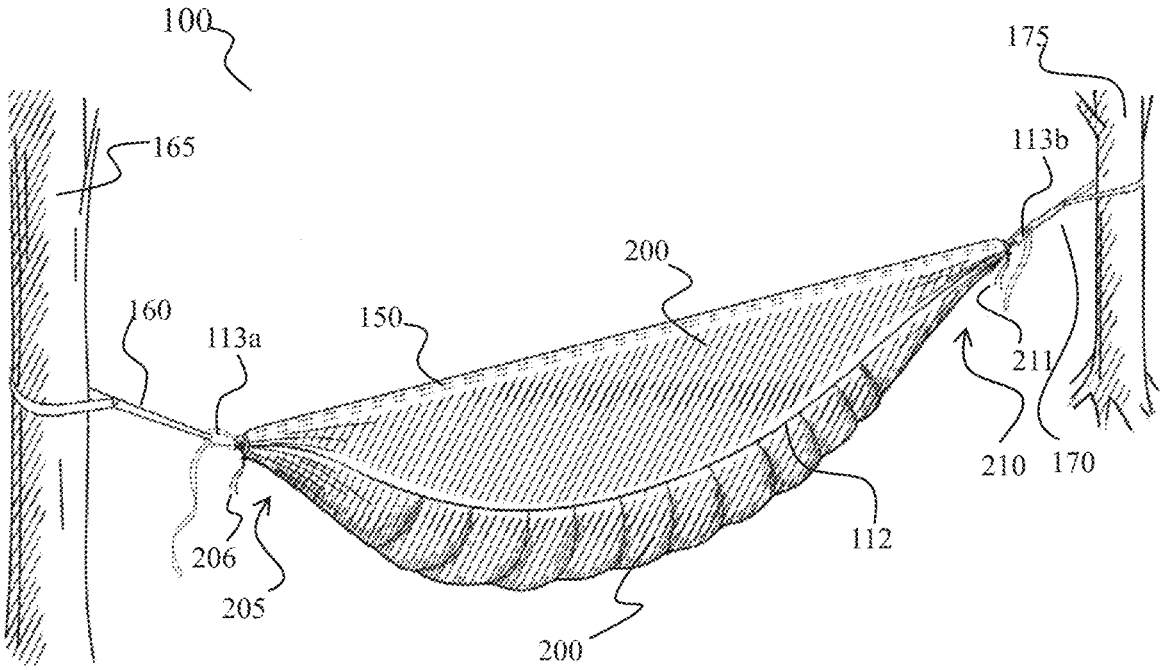
FIG. 4 shows an elevated angle view of a hammock with a shell installed over a tension line.
Figure 5:
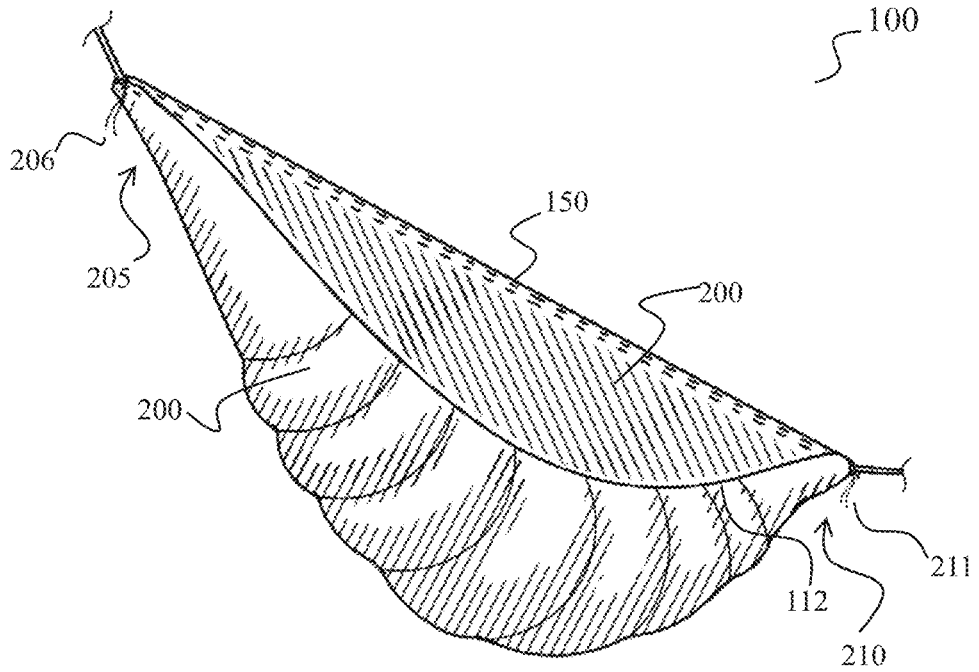
FIG. 5 shows a bottom angle view of a hammock with a shell installed over a tension line.
Figure 6:
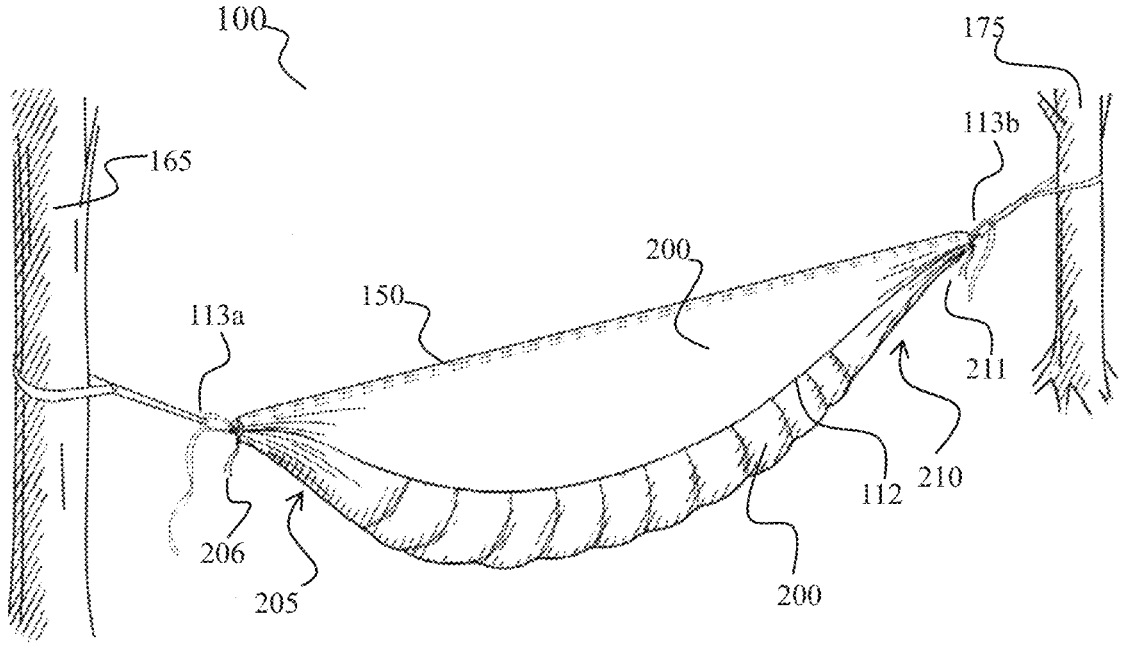
FIG. 6 shows an elevated angle view of a hammock with a shell installed over a tension line, with cinch cords for closing the end holes of the shell.
Figure 7:
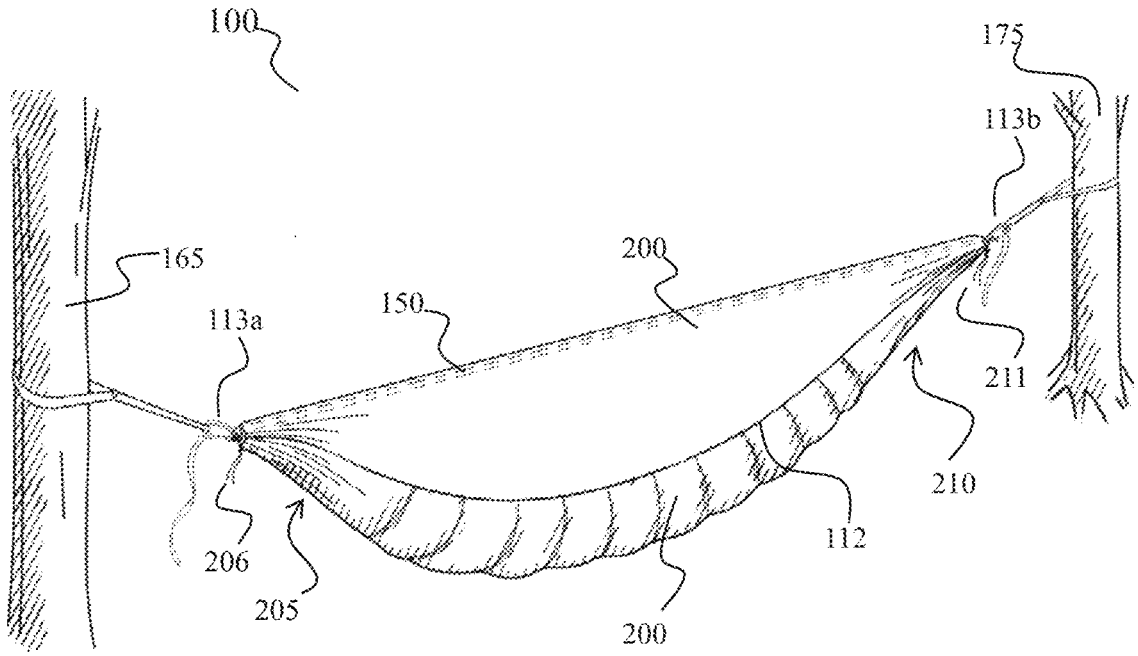
FIG. 7 shows an elevated angle view of a hammock with a shell installed over a tension line, with cinch cords for closing the end holes of the shell.

As shown in FIGS. 2-3, a tension line 150 may be installed between ends 116 and 118 of hammock 110. As described herein below, the primary purpose of tension line 150 is to hang and/or support shell 200. A secondary purpose is a mechanism wherein tension in the hammock can be reduced and taken by the tension line. In one embodiment, tension line 150 may be 1" (one inch) nylon webbing, and may include securement adapters 151 and 152 at each end for securing tension line 150 to a support structure so that tension line 150 runs above hammock 110.

For example, as shown in FIGS. 2-3, tension line 150 may comprise loops 151 and 152 formed by sewing the ends of tension line 150 onto themselves. In alternative embodiments, plastic clips or loops, metal clips or loops, or heavy-duty rubber, or other solutions may be used to secure tension line 150 to hammock support loops 113*a* and 113*b* or to hammock installation straps 160 and 170.

Tension line 150 may be adjustable in length. In one embodiment, tension line 150 may comprise two segments of nylon webbing connected by a cam. Pulling on the cam may tighten tension line 150, and turning tension line 150 outward may loosen tension line 150. Other embodiments may use a ratchet, or a knot, or a "whoopie" sling (well-known to hammock users)

Tension line securement adapters 151 and 152 may be secured to trees 165 and 175 as shown in FIGS. 2-3, or may be secured to any other support structure such that tension line 150 runs above hammock 110, and along the length of hammock 110.

In one embodiment, tension line 150 may have hanging adapters, i.e., clips, loops, etc., for hanging the shell 200 from the tension line 150, or for securing shell 200 in place when draped over tension line 150, or for otherwise securing shell 200 to tension line 150, or for supporting shell 200 from tension line 150. These hanging adapters can also be utilized for hanging and storage of gear, equipment, or other items.

In an alternate embodiment, tension line 150 may include adapters for hanging shell 200 from the bottom of tension line 150.

Shell

As shown in FIGS. 3-13, shell 200 is a piece of material that is tubular, i.e., it has holes at either end. Shell 200 is sized, shaped, and contoured to drape over tension line 150 and sides 112 and 114 of hammock 110, and under hammock 110. In an alternate embodiment, shell 200 may hang from tension line 150 or otherwise be held up or supported by tension line 150.

As shell 200 hangs under the underside of hammock 110, an air insulation layer 230 is created between shell 200 and underside of hammock 110. Air insulation layer 230 insulates, i.e., keeps heat in the space immediately below and above and around hammock 110, i.e., in the space occupied and around a user that may be sleeping in the hammock. Although an air insulation layer of almost any thickness will provide some insulation benefit, experimentation and theoretical analysis have shown that a thickness of approximately ½" (one half inch) may provide significant insulation properties. A thickness of less than ½" (one half inch) provides some insulation benefits, but may be suboptimal because the thickness could be increased for improved insulation. A thickness greater than ½" (one half inch) provides some insulation benefits, but may be suboptimal because the thickness allows for too much air movement, resulting in decreased insulting properties.

The dimensions of air insulation layer 230 disclosed herein are exemplary. The effectiveness of particular dimensions of air insulation layer 230 may depend on outside temperature, humidity, other weather conditions, size/weight of person using hammock 110, and/or insulation properties of shell 200 and/or hammock 110.

As shown in FIGS. 3-7, ends 205 and 210 of shell 200 may comprise elastic cinch cords 206 and 211, which may run in and/or around the contours of ends 205 and 210, and may include drawstring buttons for cinching and closing, in whole or in part, the hole of end 205 and/or the hole of end 210. Many other solutions are available and known in the art for closing a hole in a piece of fabric, and all such materials and/or solutions are within the scope of this disclosure.

In one embodiment, ends 205 and 210 of shell 200 may be approximately 3-5" (three to five inches) in diameter. In an alternate embodiment, ends 205 and 210 of shell 200 may be approximately 3' (three feet) in diameter, which may be large enough to pull shell 200 like a sleeping bag over a user in hammock 110.

Shell 200 may be a continuous piece of material that encompasses hammock 110, or shell may have a zipper seam, or some other type of seam. In general, a continuous piece of material may be desirable to optimize insulation properties. Tight seams, good zippers, or insulation for a seam may minimize undesirable decrease in insulation effectiveness at seams, as well as other undesirable artifacts associated with seams (e.g., loss of weatherproofing and/or waterproofing properties).

In one embodiment, shell 200 may be made out of nylon, a material comprising nylon in part, lightweight ripstop nylon, silicone coated nylon, silicone impregnated nylon, aluminized nylon, or other material(s) known in the art. In some embodiments, shell 200 may include mesh windows for airflow. In general, shell 200 may be made of many different types of materials. Important characteristics of the material for shell 200 include at least weight, weatherproof characteristics, strength, and durability.

In one embodiment, shell 200 may be partially or wholly waterproof. For example, shell 200 may be treated by one of many waterproofing agents and/or processes known in the art, or shell 200 may have a waterproof layer, or any other waterproofing solution or approach known in the art. In one embodiment, seams and/or zippers may be waterproofed by treatment with silicone coating.

The inner side of shell 200 may be partially or wholly reflective. Such a reflective layer, coating, or surface may comprise, or may be applied by metal deposition, e.g., with aluminum, both lightweight and high emmisivity and low absorption levels. In another embodiment, the reflective inner surface may be formed by aluminization. The reflective inner surface of shell 200 may reflect infrared light and/or heat to retain heat within shell 200. In general, many well-known surface coatings and/or applications for reflecting heat may be used to improve heat retention within shell 200. In one embodiment.

As shown in FIGS. 8*a*, 8*b*, 11, 12, and 13, shell 200 may be sized, shaped, and contoured to track shape formed by tension line 150, hammock edges 112 and 114, and underside of hammock 110 when hammock is occupied by a user. Although shape, size, and contour of shell 200 track the shape, size, and contour of hammock 110, shell 200 is larger than hammock 110 so that shell 200 may fit around and enclose hammock 110 and people of many shapes and sizes. When shell 200 has been installed around hammock 110, shell 200 is draped over tension line 150 (or is otherwise hung from or supported by tension line 150), rests on hammock edges 112 and 114, and droops under the underside of hammock 110.

Figure 11:
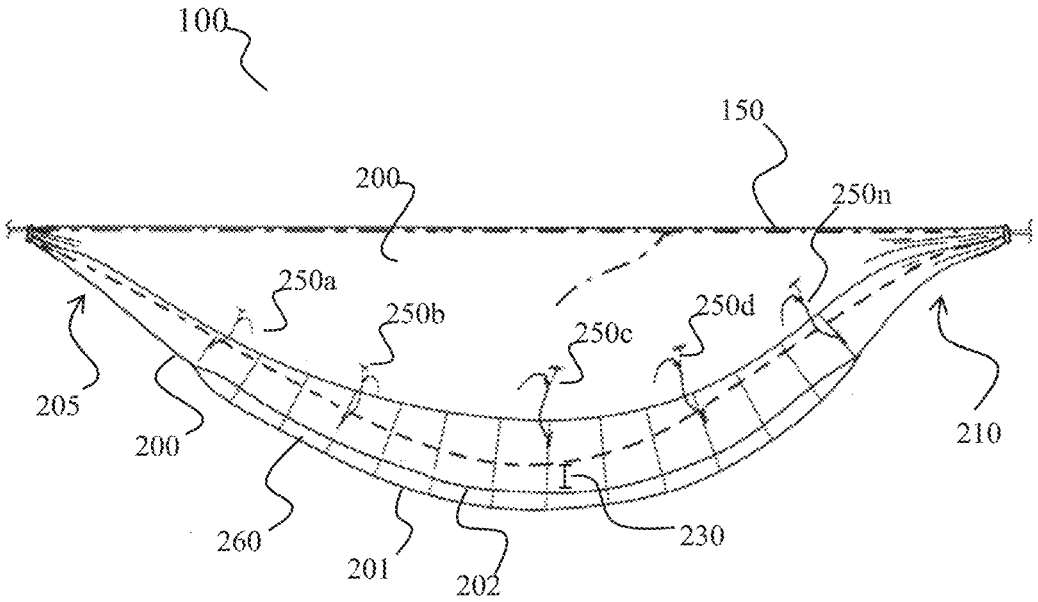
FIG. 11 shows a level cross section view, from the side, of a hammock with a shell installed over a tension line, wherein the shell includes an insulation layer.
Figure 12:
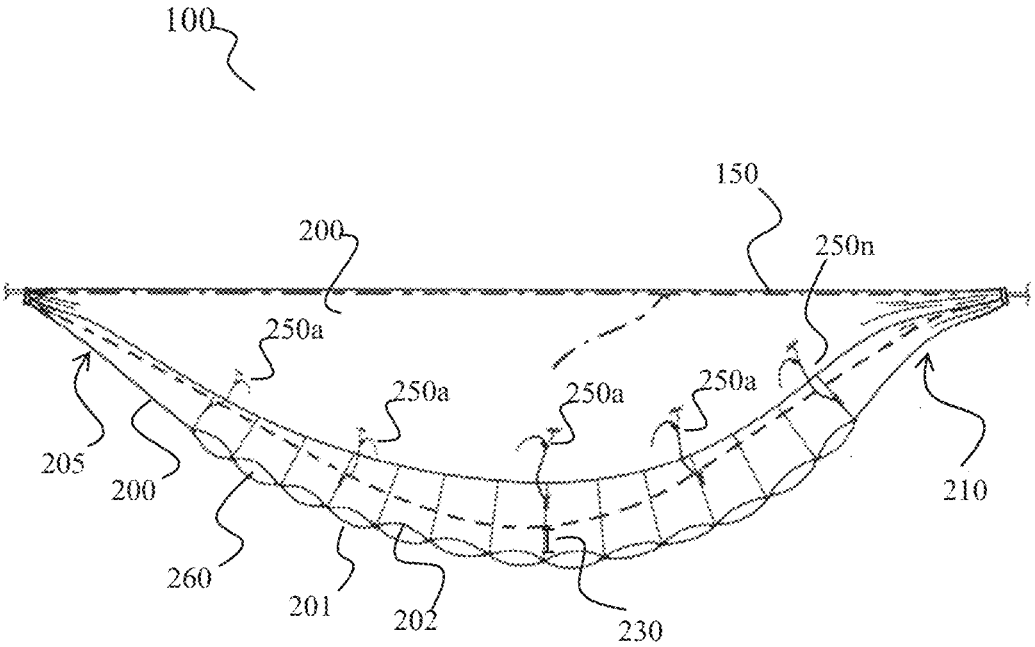
FIG. 12 shows a level cross section view, from the side, of a hammock with a shell installed over a tension line, wherein the shell includes a ribbed insulation layer.
Figure 13:
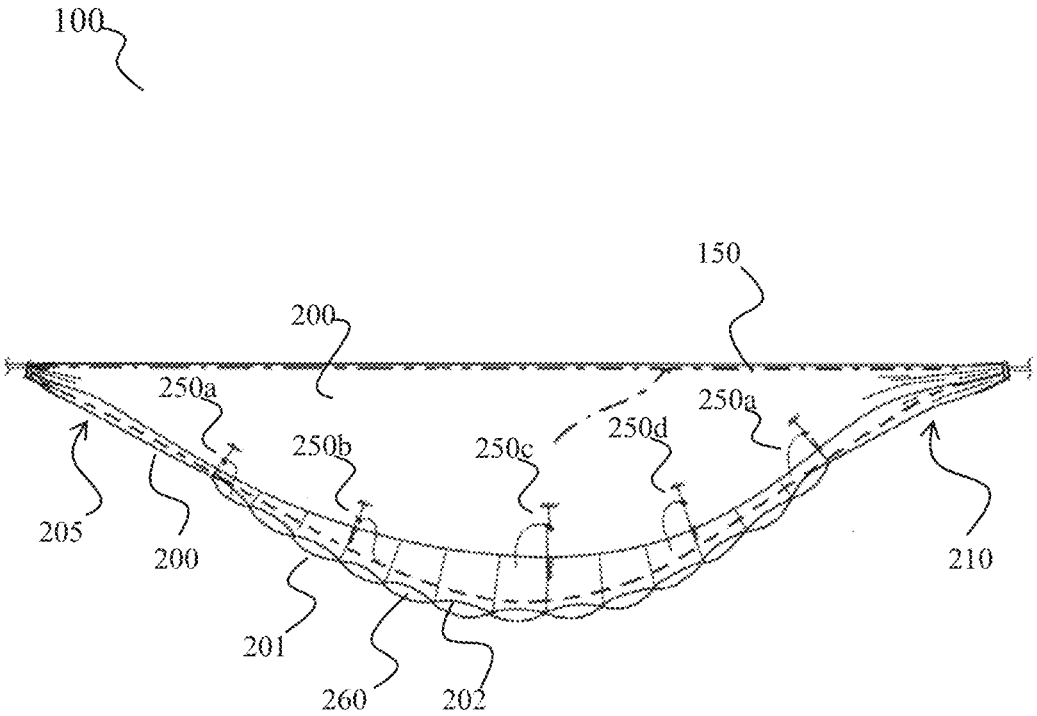
FIG. 13 shows a level cross section view, from the side, of a hammock with a shell installed over a tension line, wherein the shell includes a ribbed insulation layer, and wherein the shell has been tightened to decrease the size of the air insulation layer.

Shell 200 may include a shape adjustment system for changing the shape of shell 200 that hangs under hammock edges 112 and 114. In one embodiment, as shown in FIG. 11-13, the shape adjustment system may comprise a set of elastic cinch adjustment cords 250*a-n*. The lower end of each of cinch adjustment cords 250*a-n* is secured to shell 200, e.g., by sewing, and the upper end of each of cinch adjustment cords 250*a-n* is secured to shell 200, e.g., by sewing. By using the drawstring buttons in each of cinch cords 250*a-n* to tighten and loosen cinch cords 250*a-n*, shell 200 may be cinched, scrunched, or folded, thereby increasing or decreasing the thickness of air insulation layer 230. Because different users of hammock shell system 100 may have different body weights, body shapes, or sleeping habits, or based on any other uses of hammock shell system 100, adjusting shaping of shell 200 by using the shape adjustment system comprising cords 250*a-n* allows for improving, optimizing, and/or adjusting the thickness and/or shape of air insulation layer 230, thereby improving, optimizing, or adjusting the insulating properties and benefits of air insulation layer 230.

Many other systems, components, and/or processes may be used to adjust the shape of shell 200. For example, snaps, velcro, ties, or straps on inner surface of shell 200 may be used to cinch, scrunch, or fold shell 200 to adjust the shape of shell 200, thereby adjusting the thickness and/or insulating properties of air insulation layer 230.

Of course, in situations in which maximum insulation characteristics are not necessary, e.g., when it is maximum insulation results in too much warmth or heat, the shape of shell 200 as it hangs under the bottom of hammock 110 may be adjusted to increase or decrease the temperature of the bottom of the hammock, or to otherwise adjust the insulation properties of shell 200 and/or the dead air space trapped between shell 200 and bottom of hammock 110.

Figure 8A:
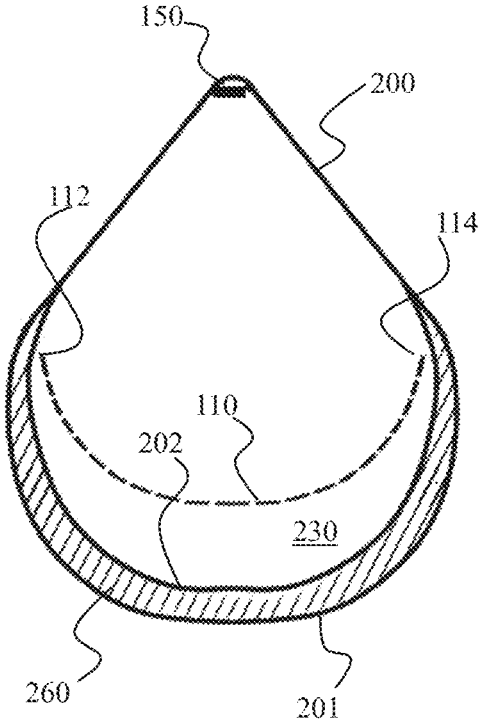
FIG. 8*a* shows a level cross section view, from one end, of a hammock shell system in which the shell has not been tightened.
Figure 8B:
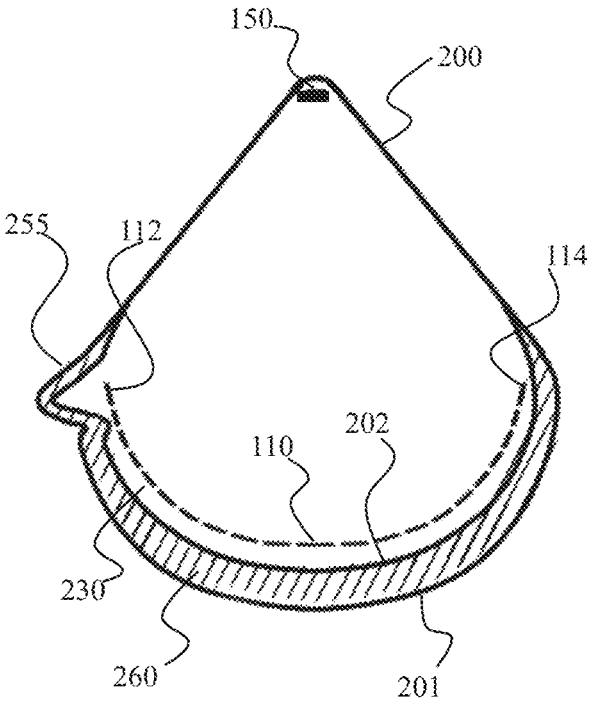
FIG. 8*b* shows a level cross section view, from one end, of a hammock shell system in which the shell has been tightened.
Figure 9:
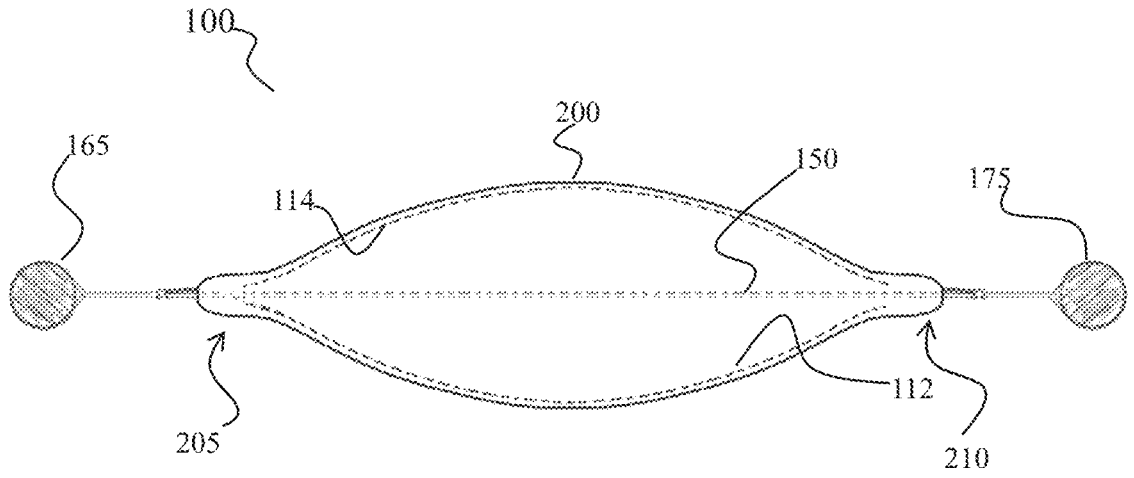
FIG. 9 shows a top-down cross section view of a hammock with a shell installed over a tension line.

FIGS. 8*a* and 8*b* show a cross section of Hammock Shell System 100 from the perspective of one of the ends 116 or 118 of hammock 110. FIG. 8*a* shows Hammock Shell System 100 in a state in which cinch cords 250*a-n* have not been tightened, so air insulation layer 230 is relatively thick. FIG. 8*b* shows Hammock Shell System 100 in a state in which cinch at least some of cinch cords 250*a-n* have been tightened at least in part, thereby compacting and decreasing air insulation layer 230, resulting in bunching 255 of the fabric comprising shell 200.

FIGS. 12 and 13 shows Hammock Shell System 100 in an untightened and tightened state, respectively, but FIGS. 12 and 13 show a cross section view from the side instead from an end as shown in FIGS. 8*a* and 8*b*.

In some embodiments, shell 200 may be made of or filled with, in whole or in part, insulating material. For example, FIGS. 8*a* and 8*b* show a cross section (viewing hammock shell system 100 from the end) of shell 200 in which shell 200 is filled in part with insulating material 260. FIGS. 11, 12, and 13 show a cross section (showing hammock shell system 100 from the side) of shell 200 in which shell 200 is filled in part with insulating material 260. For example, insulating material 260 may be high loft bird down, high loft synthetic down, other types of bird down or synthetic down, compressible foam, insulating mat, inflatable rubber or one of many other insulating materials known in the art. Using a compressible insulating material may be desirable because hammocks are often used for camping and/or backpacking, and therefore must be packed as compactly as possible to fit in a backpack or in a car or in another restricted space.

It may be desirable and/or necessary to keep insulating material 260 from relocating and/or bunching into one or more parts of air insulation layer 230. In general, it is desirable for insulating material 260 to be substantially uniformly distributed across the surface area of shell 200. This may be accomplished in many ways. For example, as shown in FIGS. 11, 12, and 13, shell 200 may comprise an upper layer 201 and a lower layer 202, and upper layer 201 and lower layer 202 may be sewn together to keep insulating material 260 between two such seams from moving or relocating. Depending on the insulating material, other solutions may be used to maintain a substantially uniform distribution of insulating material 260 across the surface area of shell 260. For example, glue, other adhesives, plastic tubing or other enclosures, baffles, or other schemes to keep insulating material 260 in place.

In one embodiment, baffles may be sewn in or otherwise incorporated into shell 200. Using baffles may be beneficial because baffles maintain a more uniform thickness and avoid uninsulated seams.

As shown in FIGS. 11, 12, and 13, insulating material 260 may be included in shell 200 in the portion of shell 200 that hangs beneath hammock edges 112 and 114. Insulating material may also be included in other parts of shell 200, e.g., in the portion of shell 200 that is above hammock edges 112 and 114.

Many different types of insulating material may be used to fill shell 200, or as a material for shell 200, or as a layer for shell 200. Because the effectiveness of most insulating materials is inversely related to the material's density (i.e., insulation properties increase as density decreases), and further because it is generally desirable to be able to pack camping gear, including a hammock, as compactly as possible, an insulating material with good compacting and expanding properties may be desirable. Compacting properties may include how densely the material can be packed, and how easy it is to pack the material to a particular density.

Expanding properties may including a material's ability to expand after being compacted, the time required for a material to expand after being compacted, and a material's ability to expand after repeated compaction.

One insulating material with good compacting and expanding properties is 800 or 900 fill-power high loft bird down.

In one embodiment, shell 200 may include clips, ties, or other solutions for securing shell 200 to tension line 150 so that shell 200 does not slip, slide, or otherwise get displaced from side to side where shell 200 drapes over tension line 150.

Figure 10:
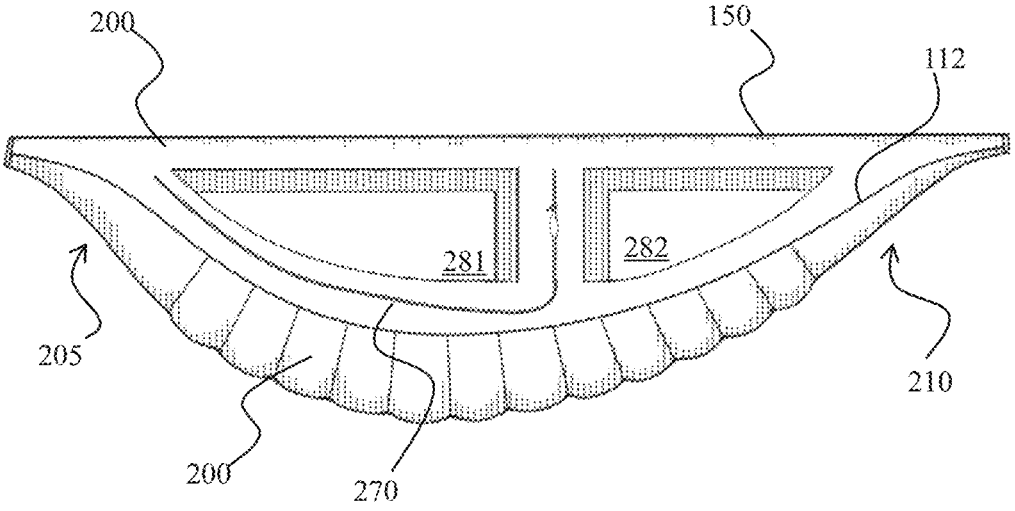
FIG. 10 shows a side view of a hammock with a shell installed over a tension line, and also shows an entry door and two windows.

As shown in FIG. 10, shell 200 may include door 270, which may be a zipper door such as are well known for tents and other applications. Door 270 may have many shapes. In general, door will be large enough for a person to enter and exit shell 200. FIG. 10 shows one exemplary shape for door 270. Other types of doors or entries may also be used. In general, it will be preferable for door 270 to have waterproof, or substantially waterproof, and/or protected seams, so that rain or other water does not enter through door 270 or seams on door 270.

In some embodiments, shell 200 may include windows and/or vents as are well known in the art, e.g., in the field of tents and camping equipment. Such windows and/or vents may open and close using zippers or other means, and may include screens and/or netting to keep insects, debris, or other items from entering shell 200.

Method

A user may set up and/or use hammock shell system 100 as follows:

A user may slide shell over end of hammock.

A user may wrap first hammock installation adapter around first support tree 165, and may thread end of first hammock installation adapter through adjustment loop 163*n*.

A user may wrap second hammock installation adapter around second support tree, and may thread end of second hammock installation adapter through adjustment loop.

A user may secure hammock adapter to first hammock installation adapter.

A user may secure hammock adapter to second hammock installation adapter.

A user may set up tension line by securing first tension line securement adapter to first hammock installation adapter, and by securing second tension line securement adapter to second hammock installation adapter.

A user may tighten tension line using a tightening mechanism or apparatus on tension line.

A user may set up shell by sliding shell over hammock as shell is expanded.

A user may adjust shell by adjusting one or more of shell adjustment cords. In one embodiment, user may measure the dimensions of air insulation layer using one of many measurement tools known in the art, or may approximately measure, e.g., by using his/her hand width or thickness or finger width or thickness.

A user may secure shell in place on tension line to keep shell from sliding side-to-side on tension line.

These steps do not necessarily need to be performed in the order disclosed herein, and some steps may be omitted depending on particular applications or circumstances.

What is claimed is:

1. A hammock insulation system, comprising:
a hammock;
a tension line; and
a shell;
wherein:
the hammock is configured to be suspended in the air;
the tension line is configured to run above the hammock along the length of the hammock;
the shell is made at least in part from a flexible material;
the shell is configured to envelop at least a portion of the hammock along the length of the hammock;
the shell is supported by the tension line;
the shell rests on and drapes over the edges of the hammock and under the bottom of the hammock to define an airspace between the shell and the bottom of the hammock; and
the portion of the shell under the bottom of the hammock is substantially non-air-permeable.

2. The system of claim 1, wherein the shell further comprises a shape adjustment system for adjusting the shape of the shell as it drapes over the edges of the hammock and hangs under the bottom of the hammock.

3. The system of claim 2, wherein the shape adjustment system comprises, at least in part, at least one cinch cord.

4. The system of claim 2, wherein the shape adjustment system comprises, at least in part, a set of two or more cinch cords disposed along the interior of one side of the shell.

5. The system of claim 1, wherein the length of the shell is substantially the same as the length of the hammock.

6. The system of claim 1, wherein the shell further comprises an end-closing system for closing, in full or in part, at least one opening at either end of the shell.

7. The system of claim 6, wherein the end-closing system comprises, at least in part, a at least one cinch cord.

8. The system of claim 1, wherein the distance between the shell and the lowest point on the bottom of the hammock is approximately one half inch (0.5 inches).

9. The system of claim 1, wherein the shell is supported by the tension line by hanging, directly or indirectly, over the tension line.

10. The system of claim 1, wherein the shell is supported by the tension line by hanging, directly or indirectly, from the tension line.

11. The system of claim 1, wherein the tension line is adjustable by at least one of length and tension.

12. The system of claim 1, wherein the shell includes insulating material for at least some portion of the shell that hangs under the hammock.

13. The system of claim 12, wherein the insulating material is secured between two layers of the shell.

14. The system of claim 13, wherein the insulating material is secured between two layers of the shell in a ribbed pattern.

15. The system of claim 14, wherein the insulating material is secured between two layers of the shell in a baffle pattern.

16. The system of claim 12, wherein the insulating material is down.

17. The system of claim 1, wherein at least some of the interior surface of the shell is reflective.

18. The system of claim 1, wherein at least some of the exterior surface of the shell is waterproof.

19. A method for insulating a hammock, comprising:
hanging a hammock having two ends;
installing a tension line to run above the hammock along the length of the hammock;

installing a shell to envelop the hammock, wherein:

the shell is supported by the tension line;

the shell rests on and drapes over the sides of the hammock and under the bottom of the hammock to define an airspace between the shell and the bottom of the hammock; and the portion of the shell under the bottom of the hammock is substantially non-air-permeable; and closing the two ends of the shell to trap air between the portion of the shell under the bottom of the hammock, the edges of the hammock where they meet the shell, and the closed ends of the shell.

20. The method of claim 19, wherein the shell comprises a shape adjustment system; and further comprising using the shape adjustment system to adjust the shell so that the distance between the shell and the lowest point on the bottom of the hammock is approximately one half inch (0.5 inches).

* * * * *